US007674073B2

(12) United States Patent
Heskin et al.

(10) Patent No.: US 7,674,073 B2
(45) Date of Patent: Mar. 9, 2010

(54) MODULAR CONCRETE SUBSTRUCTURES

(75) Inventors: David A. Heskin, Houston, TX (US); Donald L. Andress, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 193 days.

(21) Appl. No.: 11/737,620

(22) Filed: Apr. 19, 2007

(65) Prior Publication Data

US 2008/0260468 A1 Oct. 23, 2008

(51) Int. Cl.
*E02D 27/10* (2006.01)

(52) U.S. Cl. ..... 405/195.1; 405/224; 405/204

(58) Field of Classification Search ..... 405/195.1, 405/203, 204, 224, 225, 227
See application file for complete search history.

(56) References Cited

U.S. PATENT DOCUMENTS

| | | | | |
|---|---|---|---|---|
| 1,952,380 | A * | 3/1934 | Leemann | 405/227 |
| 3,624,702 | A * | 11/1971 | Meheen | 405/227 |
| 3,698,198 | A * | 10/1972 | Phelps | 405/204 |
| 4,064,669 | A * | 12/1977 | Vik | 405/195.1 |
| 4,511,288 | A * | 4/1985 | Wetmore | 405/217 |
| 4,565,469 | A * | 1/1986 | Chlumecky | 405/288 |
| 4,701,075 | A | 10/1987 | Martyshenko et al. | |
| 4,711,601 | A * | 12/1987 | Grosman | 405/204 |
| 4,767,240 | A * | 8/1988 | Ohkawara et al. | 405/225 |
| 5,186,581 | A | 2/1993 | Ngoc et al. | |
| 6,244,785 | B1 * | 6/2001 | Richter et al. | 405/195.1 |
| 7,188,574 | B2 * | 3/2007 | Converse et al. | 405/195.1 |
| 2003/0161691 | A1 * | 8/2003 | Marshall | 405/233 |

FOREIGN PATENT DOCUMENTS

| | | |
|---|---|---|
| WO | WO 81/00423 | 2/1981 |
| WO | WO 01/40581 A1 | 6/2001 |

OTHER PUBLICATIONS

Berner, Ph.D., Dale, et al., "Large Floating Concrete LNG/LPG Offshore Platforms," pp. 1-7.

Brereton, Mark, "Low Bridge Forces Change in Lake Maracaibo Platform Lifts," Offshore, vol. 59, Issue 11, Nov. 1, 1999, 3 pgs.

Theobald, Don, "Manufacture of Spun Cast Concrete Cylinder Piles" presentation slides, Gulf Coast Pre-Stress, Inc., available at http://www.gcprestress.com/CylinderPile/CylinderPile.html, 38 pgs.

(Continued)

*Primary Examiner*—John Kreck

(57) ABSTRACT

A concrete section of an offshore platform substructure comprises a concrete body with a central opening and at least one guidepost hole extending through a height of the concrete body, wherein a width of the concrete body is greater than the height. An offshore platform substructure comprises a base portion resting on the ocean floor, and a plurality of concrete support sections stacked one on top of another on the base portion. A method of assembling an offshore platform with a concrete substructure comprises locating a guidepost in the ocean floor at a well site, towing a plurality of concrete sections to the well site, sequentially engaging each of the plurality of concrete sections with the guidepost, and sequentially sinking each of the plurality of concrete sections, thereby forming a stack of concrete sections on the ocean floor.

6 Claims, 8 Drawing Sheets

OTHER PUBLICATIONS

"Alternative Heavy Lift System Uses Truss Formation," International Oil & Gas engineers, Aug. 2000, 2 pgs.

"Offshore Heavy Lift System Substitutes for Large Derrick Barges," World Oil, Dec. 1999, 2 pgs.

"High Strength Concrete," available at http://www.cement.org/basics/concreteproducts_histrength.asp, Portland Cement Association, printed on Jan. 11, 2007, 2 pgs.

"J.W. Automarine—Underwater Salvage Lifting Bags," available at http://www.offshore-technology.com/contractors/lifting/jwa/, Offshore Technology, printed on Jan. 11, 2007, 3 pgs.

"World Leading Designers of Offshore Concrete Structures," available at http://www.olavolsen.com/cosmos/show.do?id=617, Dr.techn.Olav Olsen, Inc., printed on Oct. 16, 2006, 1 pg.

"Concrete Platforms," available at http://www.olavolsen.com/cosmos/show.do?id=654, Dr.techn.Olav Olsen, Inc., printed on Oct. 16, 2006, 2 pgs.

"Disposal of Disused Offshore Concrete Gravity Platforms in the OSPAR Maritime Area," International Association of Oil & Gas Producers, Report No. 338, Feb. 2003, 40 pgs.

* cited by examiner

MODULAR CONCRETE SUBSTRUCTURES

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present disclosure is directed generally to the substructure of an offshore platform that supports drilling and production operations, and methods of assembling such a substructure in the ocean. More particularly, the present invention relates to various embodiments of modular concrete substructures that may be assembled at an offshore location to support the topsides of an offshore platform, and then optionally disassembled when the platform is no longer operational.

BACKGROUND

Offshore platforms support hydrocarbon drilling and production operations in the ocean. Regardless of the platform type, steel is the industry standard material used to construct both the substructure resting on the ocean floor and the topsides supported by the substructure and extending above the waterline to house personnel and equipment. For countries with limited capacity to fabricate steel, the requisite quantity of steel for the massive offshore platform substructures may be unavailable locally, and obtaining steel from other sources may be economically infeasible. In addition, conventional offshore platform substructures, which are custom designed and constructed in accordance with specific design criteria, such as water depth, wave and tide conditions, and ocean floor characteristics, for example, require long project lead times. Moreover, the heavy equipment necessary to install such steel substructures may not be accessible in remote countries. Therefore, a need exists for a readily available, versatile, easy to install, and economical alternative material to steel for offshore platform construction.

SUMMARY

In one aspect, the present disclosure is directed to a concrete section of an offshore platform substructure comprising a concrete body with a central opening and at least one guidepost hole extending through a height of the concrete body, wherein a width of the concrete body is greater than the height. The concrete section may further comprise one or more of the following features: at least one alignment nub on a surface of the concrete body, at least one alignment groove on a surface of the concrete body, at least one grout hole extending through the height of the concrete body, at least one window extending through at least a portion of the width of the concrete body. In various embodiments, the concrete section may be ring-shaped or polygonal-shaped. The concrete section may be formed from high-strength concrete.

In another aspect, the present disclosure is directed to an offshore platform substructure comprising a base portion resting on the ocean floor, and a plurality of concrete support sections stacked one on top of another on the base portion. The offshore platform substructure may further comprise a guidepost extending through the base portion and the plurality of concrete support sections into the ocean floor, and in an embodiment, the guidepost is grouted into position. The offshore platform substructure may further comprise a tightening cable extending into the base portion and through the plurality of concrete support sections, and in an embodiment, the tightening cable is grouted into position. The offshore platform substructure may further comprise a plurality of alignment nubs engaging a corresponding plurality of alignment grooves between adjacent concrete support sections within the plurality of concrete support sections. In an embodiment, the base portion comprises a concrete base section of substantially the same form as a concrete support section. The base portion may further comprise a concrete foundation poured into place between the concrete base section and the ocean floor. The offshore platform substructure may further comprise a window that allows ocean water to pass through the substructure. In an embodiment, the substructure tapers from a wider width at the base portion to a narrower width at an upper end of the plurality of concrete support sections. In various embodiments, each of the plurality of concrete support sections is ring-shaped with at least one central opening therethrough to receive drilling or production risers, or each of the plurality of concrete support sections is polygonal-shaped with at least one central opening therethrough to receive drilling or production risers.

In yet another aspect, a method of assembling an offshore platform with a concrete substructure comprises locating a guidepost in the ocean floor at a well site, towing a plurality of concrete sections to the well site, sequentially engaging each of the plurality of concrete sections with the guidepost, and sequentially sinking each of the plurality of concrete sections, thereby forming a stack of concrete sections on the ocean floor. The method may further comprise aligning each of the plurality of concrete sections, and locking each of the plurality of concrete sections together to prevent relative lateral movement. In various embodiments, the method further comprises applying a weight to the stack of concrete sections to mimic a weight of an offshore platform topsides, jetting in a lowermost concrete section in the stack of concrete sections into the ocean floor, and/or pouring a cement foundation between a lowermost concrete section in the stack of concrete sections and the ocean floor. The method may further comprise drilling an additional guidepost through the stack of concrete sections and into the ocean floor, extending a cable through the stack of concrete sections and applying a tension load to the cable, compressing the stack of concrete sections and grouting the cable into place after compressing the stack of concrete sections. In an embodiment, the method further comprises grouting between each of the plurality of concrete sections. The method may further comprise installing a topsides onto the stack of concrete sections. In an embodiment, installing the topsides comprises floating the topsides over the stack of concrete sections, lowering the topsides to the stack of concrete sections, and jacking up the topsides above a waterline. In another embodiment, installing the topsides comprises lifting the topsides onto the stack of concrete sections.

BRIEF DESCRIPTION OF THE DRAWINGS

For a more detailed description of the modular concrete substructures and methods of constructing same, reference will now be made to the accompanying drawings, wherein.

NOTATION AND NOMENCLATURE

Figure 1:
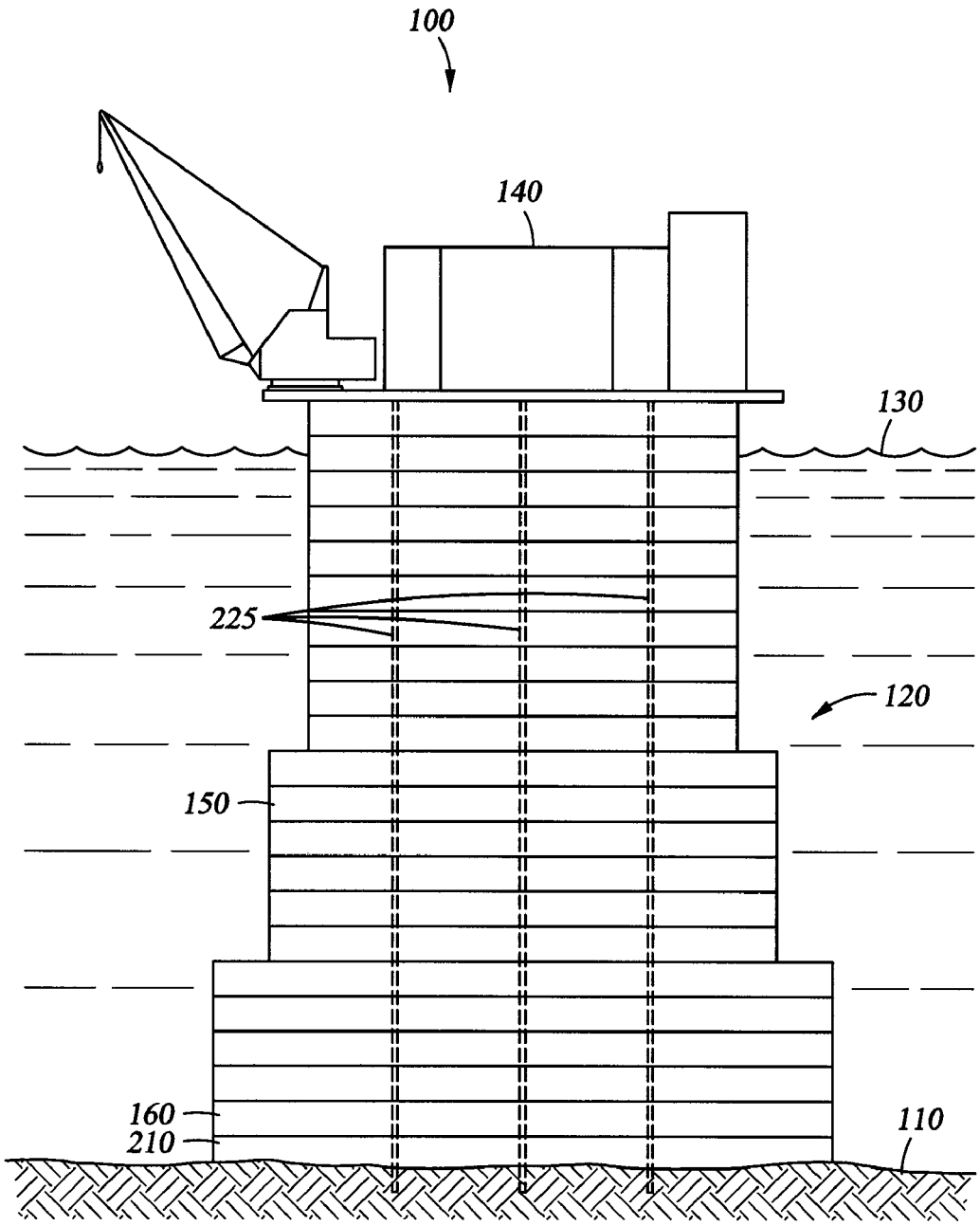
FIG. 1 schematically depicts a representative installed offshore platform comprising one embodiment of a modular concrete substructure supporting topsides.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

As used herein, the term "substructure" generally refers to the supporting base of an offshore platform that rests on the ocean floor and supports the topsides of the offshore platform. The substructure extends from the ocean floor to approximately just below or just above the waterline.

As used herein, the term "topsides" generally refers to the deck and other equipment of an offshore platform that is supported by the substructure of the offshore platform. By way of example only, representative topsides may include small, lightweight structures, such as field warehouse facilities; large complex production facilities; or specialty facilities, such as LNG storage tanks.

As used herein, the term "high strength concrete" generally refers to a concrete with a compressive strength greater than 6000 pounds per square inch as defined by the American Concrete Institute, wherein compressive strength refers to the maximum resistance of a concrete sample to applied pressure.

DETAILED DESCRIPTION

Various embodiments of a modular concrete substructure for a fixed offshore platform and methods of assembling a modular concrete substructure will now be described with reference to the accompanying drawings, wherein like reference numerals are used for like features throughout the several views. There are shown in the drawings, and herein will be described in detail, specific embodiments of the modular concrete substructure and assembly methods with the understanding that this disclosure is representative only and is not intended to limit the invention to those embodiments illustrated and described herein. The embodiments of the modular concrete substructure and methods of assembly and/or installation disclosed herein may be used in any fixed offshore platform where it is desired to support topsides. It is to be fully recognized that the different teachings of the embodiments disclosed herein may be employed separately or in any suitable combination to produce desired results.

FIG. 1 depicts one representative fixed offshore platform 100 resting at a desired location on the ocean floor 110, such as at a hydrocarbon well site, for example. The platform 100 comprises a modular concrete substructure 120 that, in this embodiment, extends from the ocean floor 110 to a height above the water level 130, but in other embodiments, the substructure 120 may extend from the ocean floor 110 to a height below the water level 130. The modular concrete substructure 120 supports topsides 140, which may house personnel and equipment needed to drill and/or produce oil and natural gas from the well site. The modular concrete substructure 120 comprises a plurality of pre-fabricated concrete support sections 150 supported by a pre-fabricated concrete base section 160 and a poured concrete foundation 210. In an embodiment, high strength concrete may be used to form the concrete base section 160, the concrete support sections 150, the concrete foundation 210, or any combination thereof. One or more guideposts 225 may extend through the modular concrete substructure 120 into the ocean floor 110 to strengthen and stabilize the modular concrete substructure 120 and resist the forces of ocean currents. The concrete base section 160, the concrete support sections 150, the concrete foundation 210, may all have a similar shape. In various embodiments, the concrete base section 160, the concrete support sections 150, and the concrete foundation 210 may be generally ring-shaped, namely circular when viewed from the top, or polygonal-shaped, such as square or rectangular, for example, when viewed from the top, and with an opening therethrough of sufficient dimension to permit the passage of one or more drilling and/or production risers. One skilled in the art will readily appreciate that the shape of the concrete base section 160, the concrete support sections 150, and the concrete foundation 210 may vary, and the concrete foundation 210 may even be irregular depending upon the quality or other characteristics of the firm bottom 220 of the ocean floor 110. In the embodiment shown in FIG. 1, the width (or diameter) of the concrete base section 160, the concrete support sections 150, and the concrete foundation 210 is greater than their respective heights.

In an embodiment, the concrete base section 160 and the concrete support sections 150 all have approximately identical dimensions. In another embodiment, as shown in FIG. 1, the width or diameter of the concrete support sections 150 used in the substructure 120 may vary from bottom to top, with the larger diameter support sections 150 being utilized in deeper water near the base section 160 and transitioning to smaller diameter support sections 150 as the water depth decreases approaching the water line 130. The use of concrete support sections 150 with varying diameters in this manner may result in a substructure 120 having a tapered shape, namely wider at the base adjacent the base section 160 and narrower at the top adjacent the topsides 140.

Figure 2:
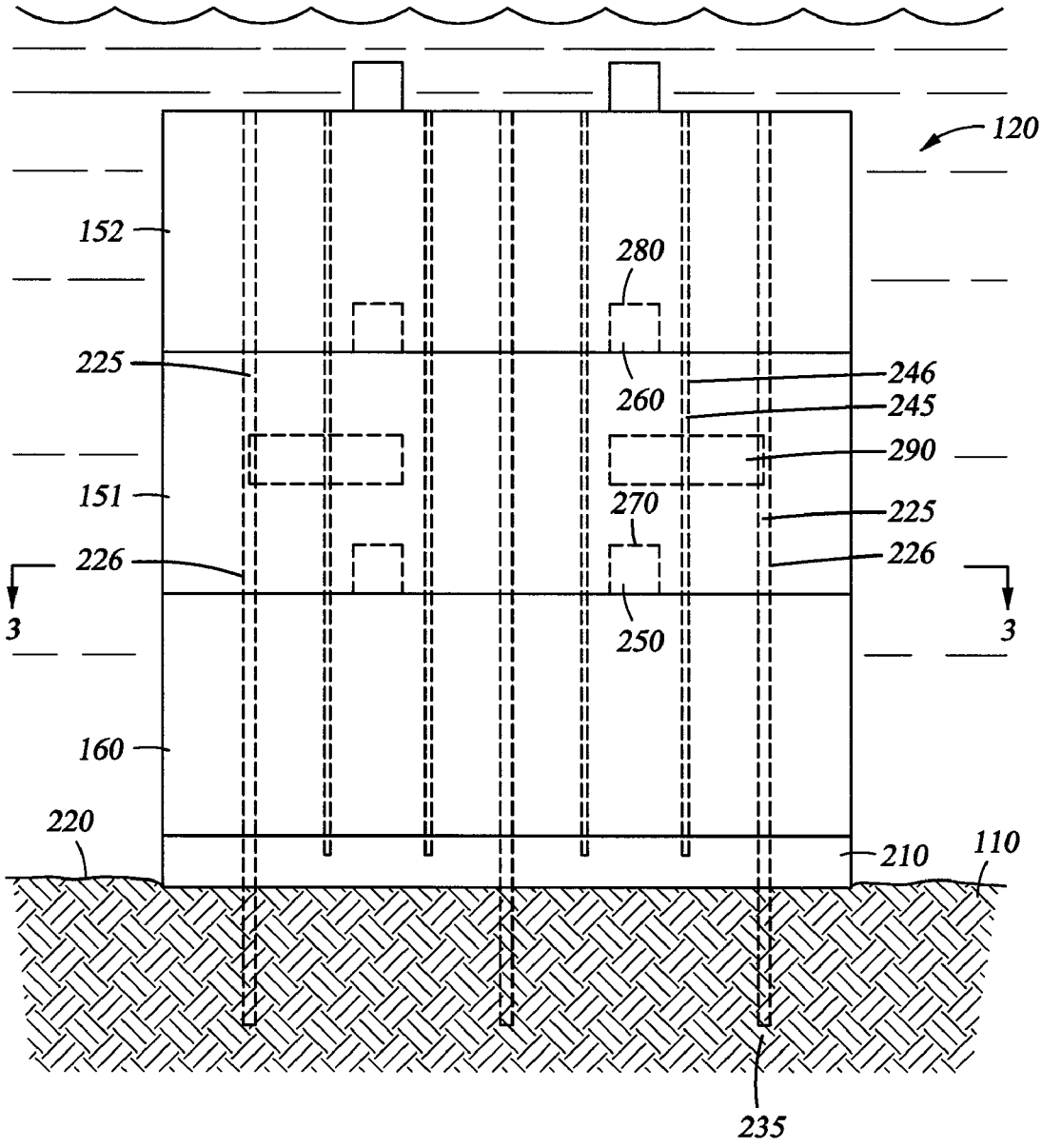
FIG. 2 is an enlarged cross-sectional side view of a plurality of representative modular concrete support sections resting on a concrete base section.
Figure 3:
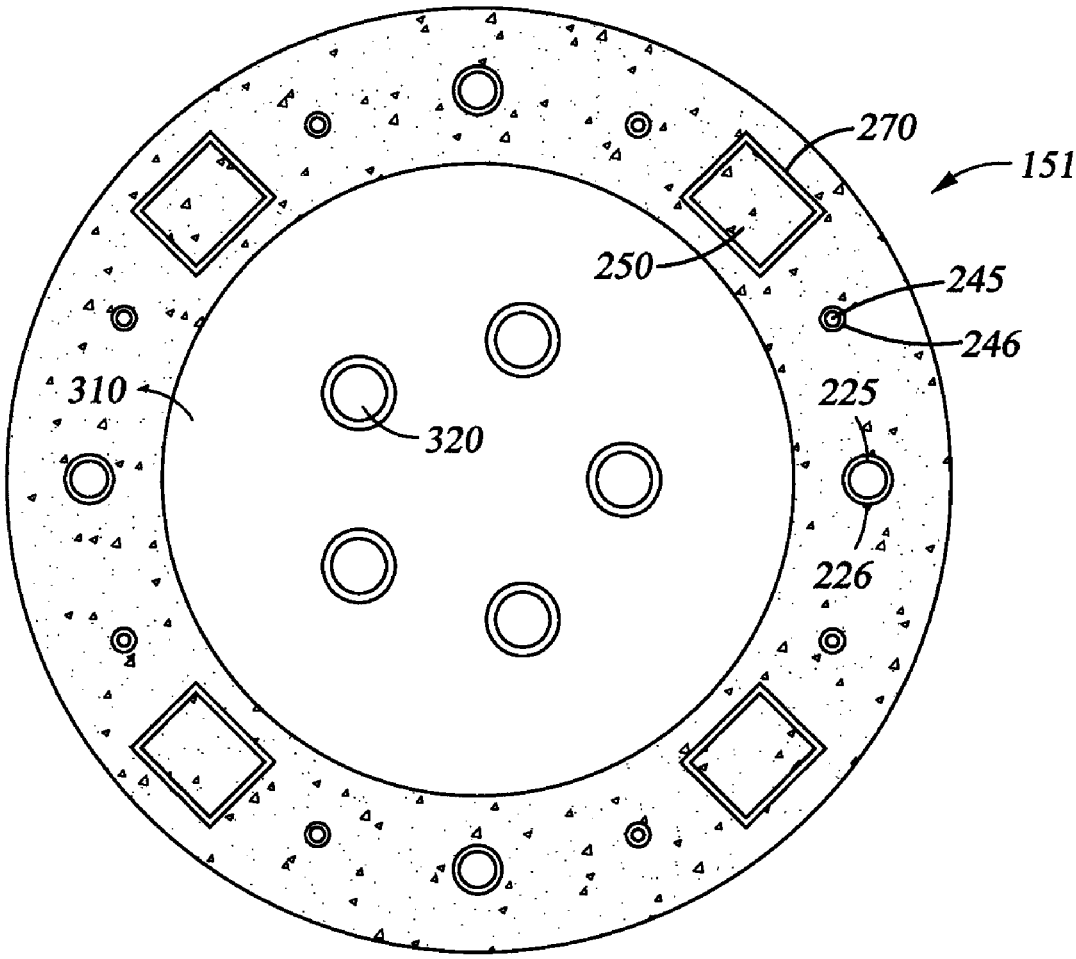
FIG. 3 is an enlarged cross-sectional top view of one of the modular concrete support sections depicted in FIG. 2.

Referring now to FIG. 2, for illustrative purposes only, an enlarged cross-sectional side view is provided of two specific supports 151 and 152. In particular, FIG. 2 depicts an individual concrete support section 151 supported by a base section 160 below and supporting a second concrete support section 152 above. FIG. 3 depicts a cross-sectional top view of the concrete support section 151, taken along section line 3-3 of FIG. 2. As shown in FIG. 2, in some embodiments, the base section 160 may be supported by a concrete foundation 210 poured between the base section 160 and the firm bottom 220 of the ocean floor 110 as will be described more fully herein.

Still referring to FIG. 2, as depicted in phantom lines, the concrete support section 151 may comprise windows 290, which allow ocean water to pass through the substructure 120 to reduce stress in the substructure 120 due to loading caused by ocean currents. The base section 160 may comprise one or more alignment nubs 250 extending upwardly from its top surface to engage one or more corresponding alignment grooves 270 in the bottom surface of the concrete support section 151. Similarly, the concrete support section 151 may comprise one or more alignment nubs 260 extending upwardly from its top surface to engage one or more corresponding alignment grooves 280 in the adjacent concrete support section 152. As depicted, the alignment nubs 250 of the base section 160 extend into the similarly shaped grooves 270 located in the concrete support section 151 to prevent lateral movement of the concrete support section 151 with respect to the base section 160, and vice versa. Similarly, the alignment nubs 260 of the concrete support section 151 extend into similarly shaped grooves 280 in the adjacent concrete support section 152 to prevent lateral movement of the concrete support sections 151, 152 with respect to one another. FIG. 2 and FIG. 3 depict alignment nubs 250, 260 and their respective alignment grooves 270, 280 as being rectangular in shape and having a particular size, number and arrangement. However, one skilled in the art will readily appreciate that the shape, size, number and arrangement of these components 250, 260, 270, 280 may vary.

One or more guideposts 225 may extend through corresponding guide conductor holes 226 in the concrete support sections 151, 152 and base section 160 into the firm bottom 220 of the ocean floor 130 for some distance, such as several hundred feet, for example, and then grout 235 may be installed around the guideposts 225 to provide additional stability for the substructure 120. FIG. 2 and FIG. 3 illustrate one possible arrangement for the guideposts 225; however, one skilled in the art will readily appreciate that the number of guideposts 225 and their arrangement may vary. In an embodiment, only one of the multiple guideposts 225 is pre-installed in the ocean floor 110 before the base section 160 and concrete support sections 150 are installed at the well site. The remaining guideposts 225, if any, are installed by drilling them through the concrete support sections 150 and the base section 160 into the ocean floor 110 after the complete modular concrete substructure 120 has been assembled at the well site, as will be discussed in more detail herein.

Cables 245 may also be inserted through grout holes 246 extending through the height of the concrete support sections 151, 152 and into the base section 160. When the cables 245 are tightened, the concrete support sections 150 compress, and then grout may be injected into the grout holes 246, thereby causing the entire substructure 120 to act as a single unit rather than a plurality of individual concrete support sections 150 stacked on a base section 160. FIG. 2 and FIG. 3 illustrate one possible arrangement for the cables 245; however, one skilled in the art will also readily appreciate that the number of cables 245 and their arrangement may vary.

The concrete foundation 210 shown in FIG. 1, which may be constructed by pouring concrete between the base section 160 and the firm bottom 220 of the ocean floor 110, provides substantially uniform support of the base section 160. Such a uniform surface is important because the base section 160 will support a great deal of weight, namely, the weight of the concrete support sections 150 and the topsides 140. Without uniform support provided by the concrete foundation 210 in contact with the firm bottom 220, areas of the base section 160 would be more heavily loaded than other areas. Such a non-uniform load acting on the base section 160 may cause it to crack and possibly fail.

Although a uniform surface is needed to support the base section 160, a concrete foundation 210 is not always required. At some well sites, the ocean floor 110 does not have a firm bottom 220. Instead, the ocean floor 110 may consist of mud or sand, for example. In those situations, the base section 160 may be seated directly on the mud or sand bottom. Because the mud or sand is soft, it conforms around the base section 160, thereby providing a uniform surface on which the base section 160 rests.

Whether the ocean floor 110 is mud, sand, or something harder, the base section 160 will be designed and constructed from material to withstand the loads placed on it without cracking or failing. The base section 160 and the concrete support sections 150 also have an opening 310 therethrough, as shown in FIG. 3, to allow passage of drilling or production risers 320 which will extend from the topsides 110 to the well below the substructure 120. Although the opening 310 depicted is circular, one skilled in the art will readily appreciate that the shape of the opening 310 may vary to accommodate the drilling and/or productions risers 320. For example, the opening 310 may be square or rectangular in shape. In addition, one skilled in the art will readily appreciate that multiple openings 310 may also be used to accommodate various configurations of drilling and/or production risers 320.

Figure 4:
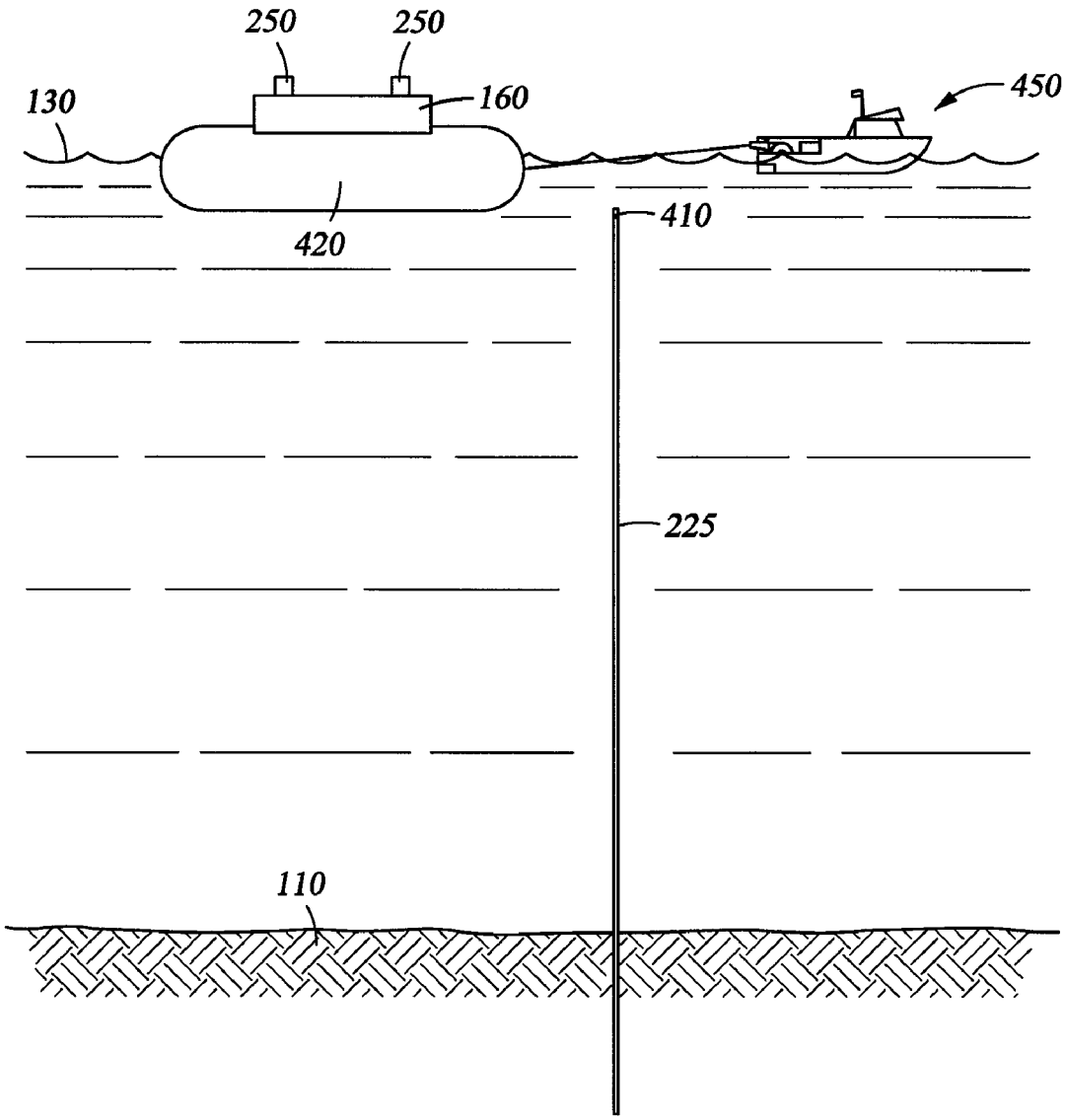
FIG. 4 through FIG. 8 depict a typical assembly sequence for a modular concrete substructure wherein the topsides may be installed by floating over the substructure and then jacking the topsides up from the substructure on legs.

FIG. 4 through FIG. 8 schematically depict a sequence of assembly operations for installation of the modular concrete substructure 120 illustrated in FIGS. 1-3. Once installed, the substructure 120 may be used to support the topsides 140, thus forming a fixed offshore platform 100 for use in drilling and/or producing oil and natural gas. For example, to assemble a production substructure 120, when drilling operations are completed at a well site, a guidepost 225 may be drilled at a desired location into the ocean floor 110 to a depth that depends upon the geotechnical characteristics of the seabed, and then left in place after the drilling rig departs the well site. Typically, the guidepost 225 is vertically driven into the ocean floor 110 to the point of refusal. This guidepost 225 may extend to just below the water surface 130. Referring first to FIG. 4, a guidepost 225 is shown inserted deep into the ocean floor 110 at a well site. A quick-connect 410 may be attached to the upper end of the guidepost 225 to permit additional piping to be connected to the guidepost 225 later, if so desired.

The substructure 120 may be assembled around the guidepost 225, first by installing the base section 160, and then sequentially installing each of the plurality of concrete support sections 150 until the substructure 120 reaches the desired height. This method of assembly allows the substructure 120 to be used in both shallow water and deepwater installation sites, and further allows for variability of penetration for soft ocean floor 110 conditions. In an embodiment, each of the base section 160 and concrete support sections 150 may be manufactured in a dry dock and then individually towed out to the well site using only a boat 450 and a simple floatation device 420, such as an underwater salvage lifting bag or a parachute type lifting bag available from J.W. Automarine of Fakenham, Norfolk, for example. Referring again to FIG. 4, the base section 160 may be towed to the well site on a floatation device 420 using a tug boat or other type of boat 450. After the base section 160 reaches the guidepost 225, divers may slowly deflate the floatation device 420 and manipulate the base section 160 onto the guidepost 225 such that the pre-installed guide conductor hole 226 in the base section 160 slides down over the guidepost 225. This is possible because the guidepost 225 does not extend all the way to the water surface 130, allowing the base section 160 to be floated over the guidepost 225 and lowered down onto it.

Figure 5:
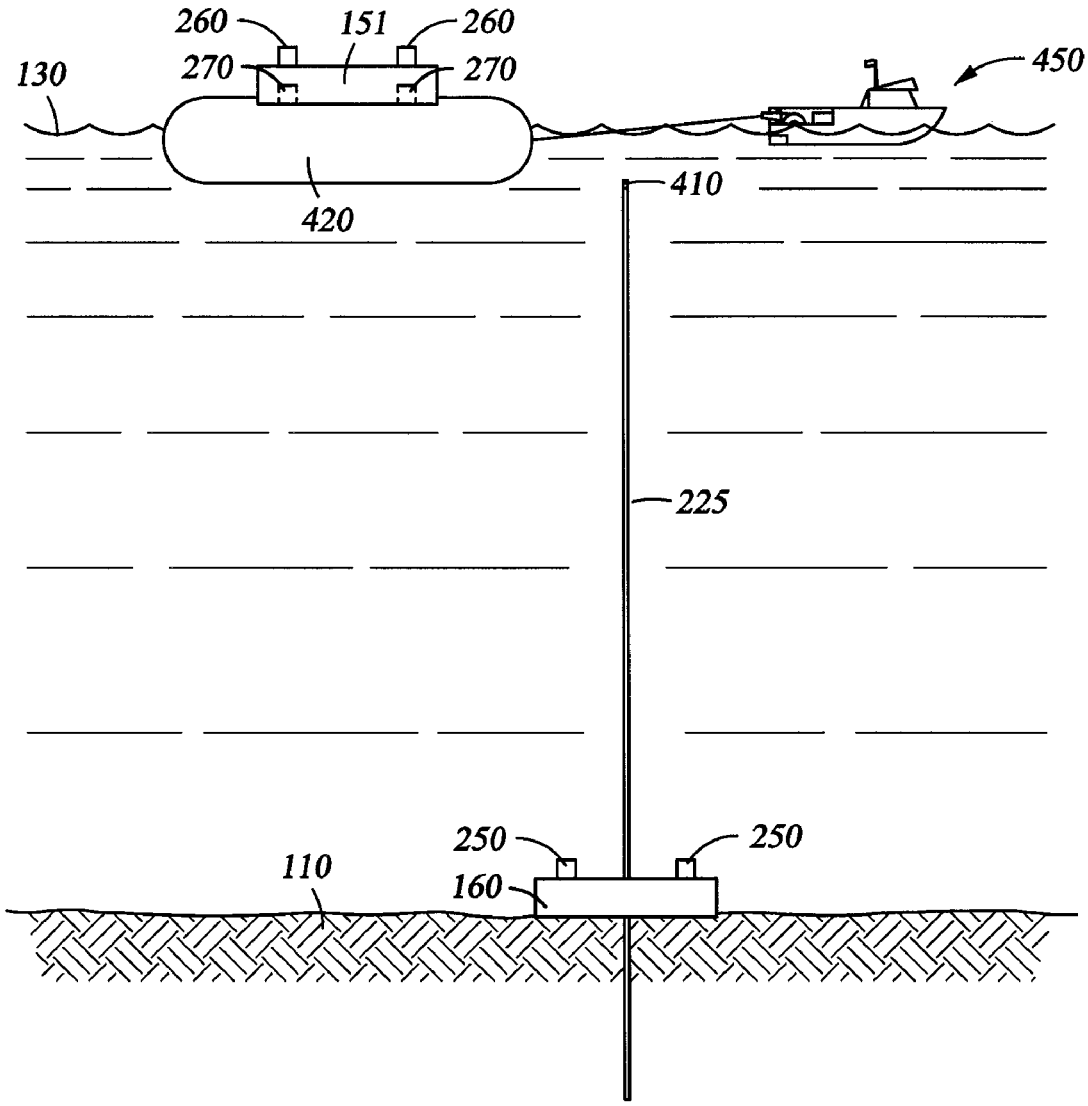

FIG. 5 depicts the base section 160 installed on the guidepost 225 and seated firmly on the ocean floor 110. Next, a concrete support section 151 is towed out on a floatation device 420 and pulled by a boat 450 to the well site. Upon arrival at the well site, divers may slowly deflate the floatation device 420 and manipulate the concrete support section 151 onto the guidepost 225 such that the pre-installed guide conductor hole 226 in the concrete support section 151 slides down over the guidepost 225. This is possible because the guidepost 225 does not extend all the way to the water surface 130, allowing the concrete support section 151 to be floated over the guidepost 225 and lowered down onto it. When the concrete support section 151 lands on top of base section 160, divers may manipulate the concrete support section 151 until the alignment grooves 270 slide over and engage the alignment nubs 250 located on top of the base section 160. Once these grooves 270 engage the nubs 250, the base section 160 and the concrete support section 151 are locked together such that lateral movement of one relative to the other is prevented, similar to the way toy interlocking building block pieces lock together, such as LEGO® brand building blocks, for example.

Figure 6:
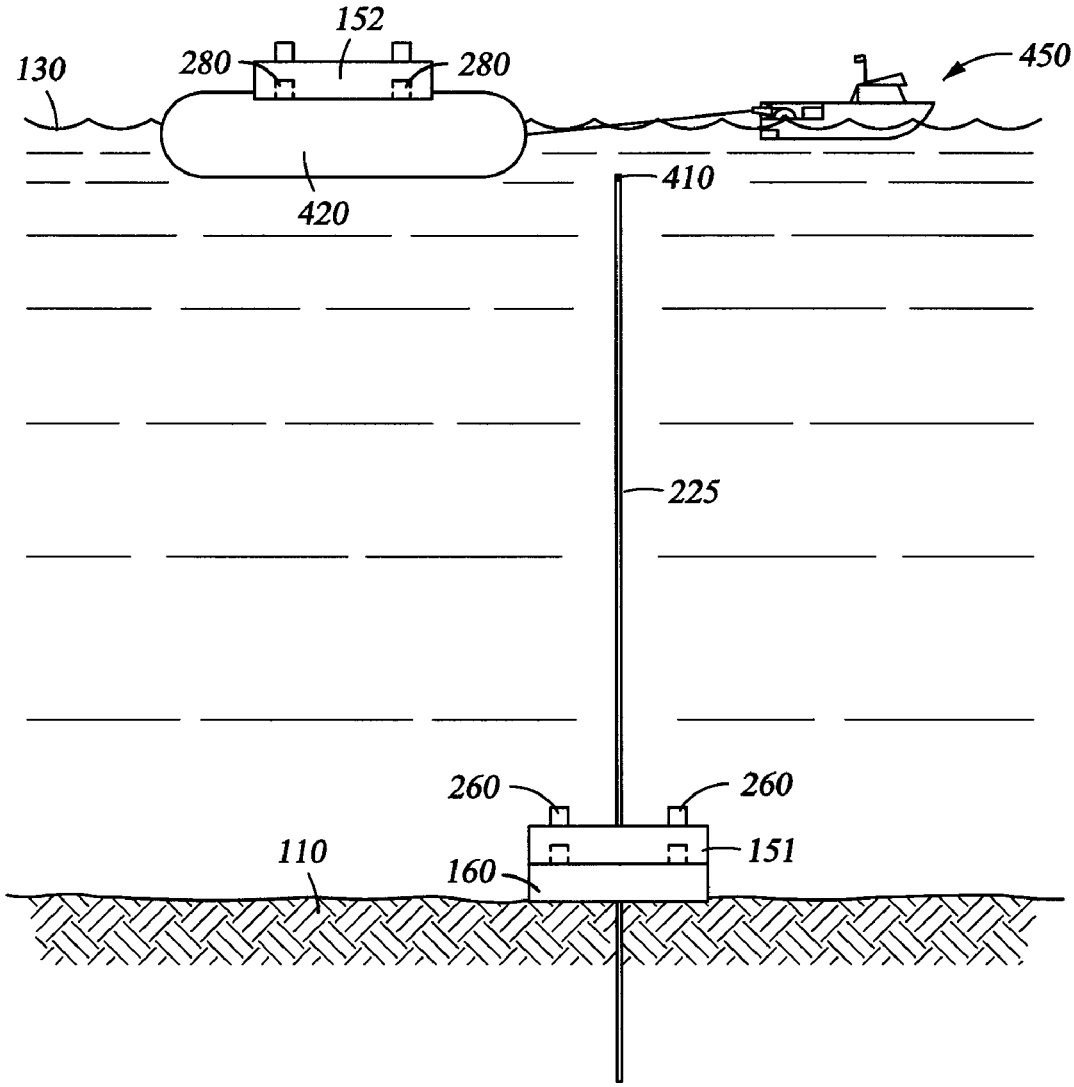
Figure 7:
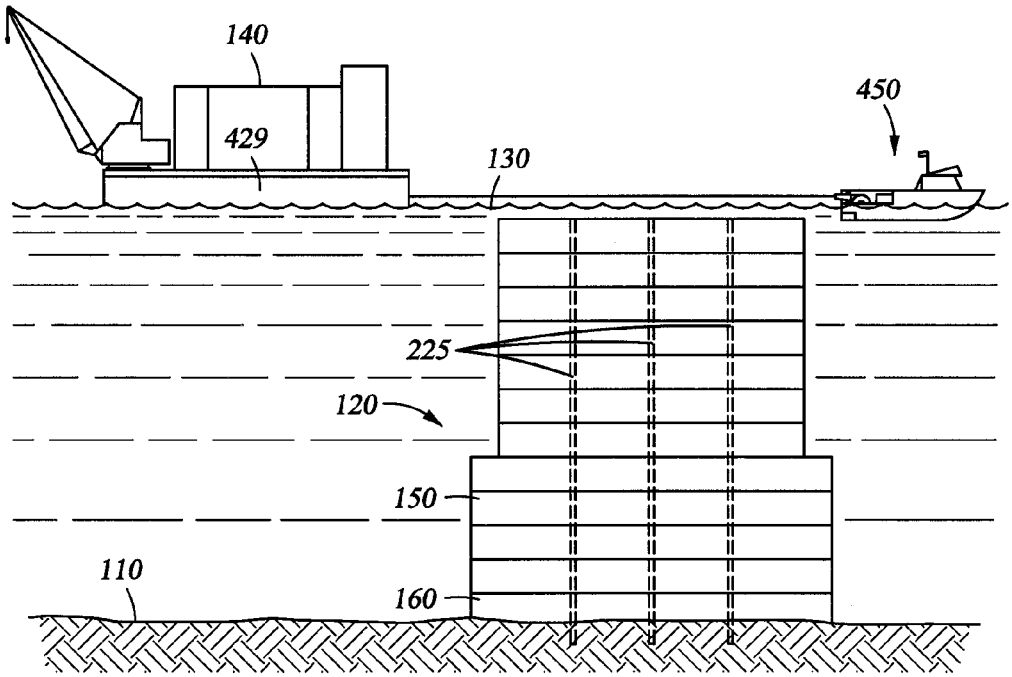

FIG. 6 depicts the base section 160 and a single concrete support section 151 installed at the well site and a second concrete support section 152 being pulled to the well site on a floatation device 420 by a boat 450. Divers may install the second concrete support section 152 on top of the first concrete support section 151 already installed, again by slowly deflating the floatation device 420 and lowering the second concrete support section 152 onto the pre-installed guidepost 225. When the second concrete support section 152 lands on top of the first concrete support section 151, divers may manipulate the second concrete support section 152 until the alignment grooves 280 slide over and engage the alignment nubs 260 located on top of the first concrete support section 151. Once these grooves 280 engage the nubs 260, the two concrete support sections 151, 152 are locked together such that lateral movement of one relative to the other is prevented. This installation procedure may be repeated, stacking additional concrete support sections 150 adjacent to ones already positioned, until the entire modular concrete substructure 120 has been installed to a desired size and height at the well site, as depicted in FIG. 7.

Once the entire substructure 120 has been positioned at the well site following the procedure described above, weight in the form of water bags may be applied to the top of the substructure 120 to mimic the weight of the topsides 140 to be installed in order to verify that the substructure 120 will not sink or settle further into the ocean floor 110. After the substructure 120 has settled, and depending on the consistency of the ocean floor 110, the base section 160 may then be grouted in to prevent lateral movement of the base section 160 relative to the ocean floor 110. If the ocean floor 110 is not a hard surface, but a soft surface consisting of mud, sand or other similar material, a concrete foundation 210 need not be constructed between the base section 160 and the ocean floor 110. Instead, divers may jet in the base section 160 by blowing the mud or sand away from the perimeter of the base section 160 to allow the base section 160 to set into the ocean floor 110 as shown in FIG. 7. If the ocean floor 110 consists of a firm bottom 220, a concrete foundation 210 as shown in FIG. 1 and FIG. 2 may be required. To construct such a foundation 210, divers may place sand bags on the ocean floor 110 in a circular pattern surrounding the base section 160. Cement is then poured into the dyke created by the sand bags until it fills up the dyke. Because cement is heavier than water, cement displaces water in the dyke as the cement fills up the dyke. Once the cement sets, the concrete foundation 210 prevents lateral movement of the base section 160 relative to the ocean floor 110.

Next, additional guideposts 225 as shown in FIG. 2 and FIG. 3 may be installed to provide additional stability for the substructure 120. A barge, or other type of boat, is positioned over the substructure 120. According to a method known as the "casing drilling method," a casing string with a drill bit attached to one end is lowered down to the substructure 120. Drillers equipped with power tongs then use the casing string with attached drill bit to drill a guide conductor hole 226 in the substructure 120. After the guide conductor hole 226 is completed, the casing string with attached drill bit is left in place to form the guidepost 225. This procedure is repeated until all remaining guideposts 225 are installed. Grout may then be injected into the guide conductors 226 and allowed to set.

After the guideposts 225 have been installed, cables 245 may be inserted into the grout holes 246 and run down through the concrete support sections 150 into the base section 160. A tension load may then be applied to the cables 245 to compress the base section 160 and concrete support sections 150. Grout may also be injected into the grout holes 246 and allowed to set, thus fixing the cables 245 in position. Additionally, grout may be injected between the base section 160 and between the adjacent concrete support section 151 and/or between each of the concrete support sections 150 to provide an additional means of cementing these individual components together. To provide a flowpath for the grout, grooves may be fabricated in the upper surfaces of the base section 160 and the upper and lower surfaces of the concrete support sections 150 around the alignment nubs 250, 260 and alignment grooves 270, 280. Compressing the base section 160 and concrete support sections 150 by tightening the cables 245 and injecting grout into the grout holes 246 to fix the cables 245 in place, as well as grouting between the base section 160 and concrete support sections 150 forms a single, sturdy substructure 120, rather than an individual base section 160 and a collection of individual concrete support sections 150, each stacked one on top of the other.

In some mild environments, the massive size and weight of the substructure 120, with applied weight from the topsides 140, may provide enough stability that neither the cables 245 nor the grout is necessary. However, in harsher environments, the weather and ocean currents may be such that using the cables 245 to compress the substructure 120 may be required, but the grouting may not be. In still harsher environments, it may be necessary to use the cables 245 to compress the substructure 120 and also to inject grout into the grout holes 246 and between the base section 160 and the concrete support sections 150 to form a stout substructure 120. One skilled in the art will readily appreciate that weather and ocean currents at the well site will dictate whether or not the cables 245 will be used and the substructure 120 grouted. Also, the ease with which the substructure 120 may be later disassembled and removed may also be a consideration in determining whether to use the cables 245 and/or grout the substructure 120. In the absence of cables 245 and grout, the disassembly and removal of the substructure 120 from the well site may be relatively easy.

Figure 8:
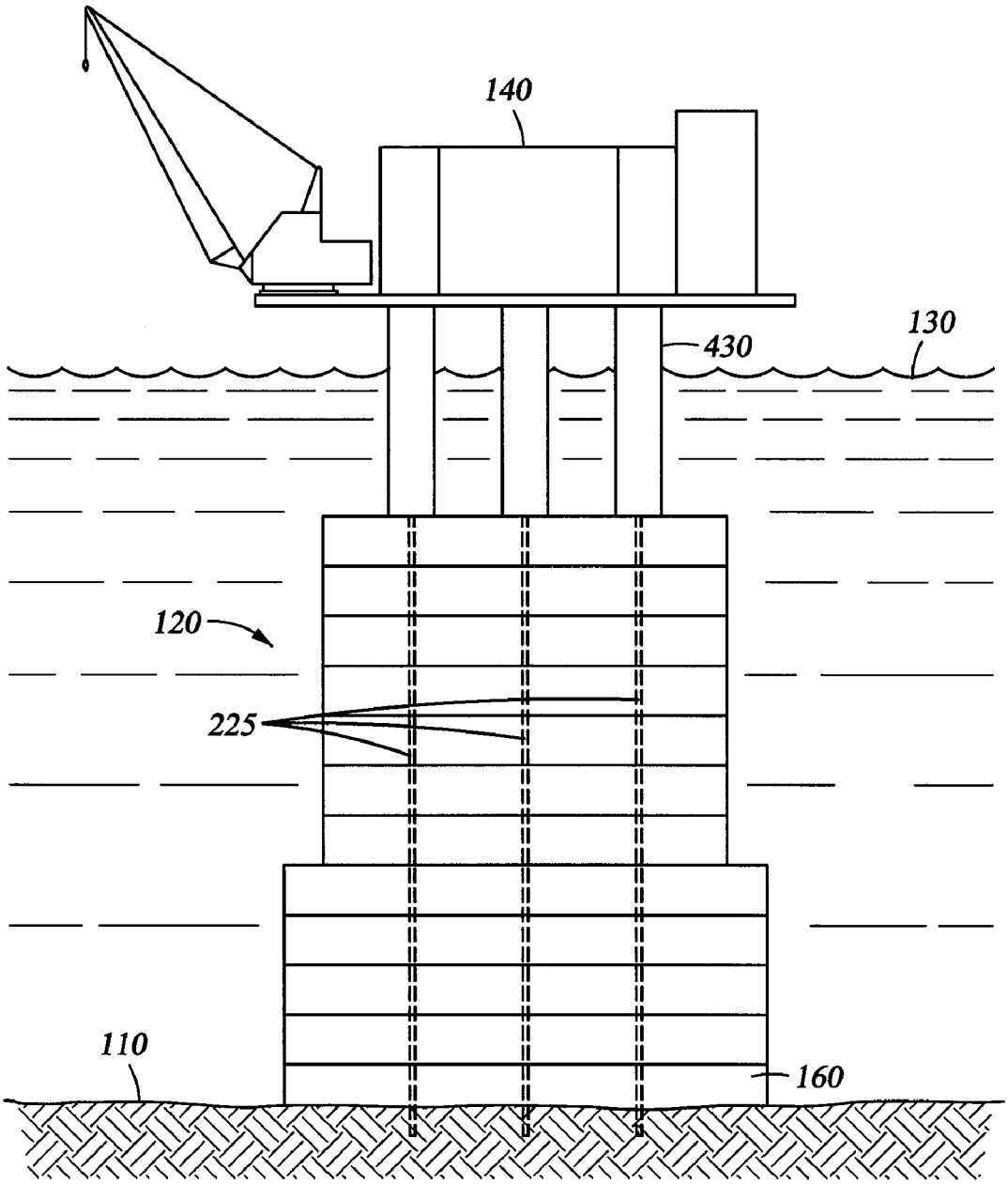

Referring again to FIG. 7, the topsides 140 may be installed on top of the completed substructure 120 by a variety of methods. In one embodiment, the topsides 140 may be floated on a floatation device 429 and pulled to the well site by boat 450. Upon arrival at the well site, the topsides 140 may be floated over the substructure 120 and slowly lowered onto the substructure 120 by deflating the floatation device 429. Turning now to FIG. 8, the topsides 140 may then jack itself up on legs 430 so that the topsides 140 rises above the substructure 120 and the water line 130. To install the topsides 140 using this float-over method requires that the top surface of the substructure 120 be located sufficiently below the water line 130 to allow the topsides 140 to float over the substructure 120. FIG. 8 depicts a topsides 140 supported by a modular concrete substructure 120 and jacked up on legs 430 above the substructure 120 and the water line 130.

In another embodiment, a heavy lift system, such as a derrick barge or the Versatruss heavy lift system employed by Versatruss Americas of Belle Chasse, La., for example, may transport the topsides 140 to the well site and lift the topsides 140 onto the modular concrete substructure 120. In this scenario, it is desirable to extend the substructure 120 above the water line 130 and into the splash zone, as depicted in FIG. 1. Under these circumstances, because the topsides 140 is positioned above the water line 130, it is not necessary to jack the topsides 140 up on legs, as discussed above. Once the topsides 140 have been positioned onto the modular concrete substructure 120 by either the float over method or the lifting method, the topsides 140 may be connected to the substructure 120 via bolts, rods, ring plates, or other means according to standard procedures familiar to those of ordinary skill in the art.

The foregoing descriptions of specific embodiments of modular concrete substructures and methods of assembly or installation to support a topsides, thus forming a fixed offshore platform, have been presented for purposes of illustration and description and are not intended to be exhaustive or to limit the invention to the precise forms disclosed. Obviously many other modifications and variations of these embodiments are possible. In particular, the size of the concrete support sections and/or base section may vary depending upon the load they are intended to support, their methods of construction, and the ease with which these components may be transported and installed. Furthermore, the material composition of the concrete used to fabricate these components may vary depending on the material strength required for a specific application and the availability of different types of concrete. The formation of the substructure may be a function of the area of the well site, the water depth, and the size and weight of the topsides to be supported. The assembly and installation methods may also vary depending on the availability of necessary equipment. For example, if a heavy lift barge is unavailable to install the topsides, the float-over method of installing the topsides, as described with respect to FIG. 7 and FIG. 8, may be utilized instead.

While various embodiments of modular concrete substructures and methods of assembly or installation have been shown and described herein, modifications may be made by one skilled in the art without departing from the spirit and the teachings of the disclosure. The embodiments described are representative only, and are not intended to be limiting. Many variations, combinations, and modifications of the applications disclosed herein are possible and are within the scope of the invention. Accordingly, the scope of protection is not limited by the description set out above, but is defined by the claims which follow, that scope including all equivalents of the subject matter of the claims.

What we claim as our invention is:

1. A method of assembling an offshore platform with a concrete substructure comprising:

locating a guidepost in the ocean floor at a well site;

towing a plurality of concrete sections to the well site;

sequentially engaging each of the plurality of concrete sections with the guidepost;

sequentially sinking each of the plurality of concrete sections, thereby forming a stack of concrete sections on the ocean floor; and applying a weight to the stack of concrete sections to mimic a weight of an offshore platform topsides.

2. The method according to claim 1 wherein first installed concrete sections are wider than later installed concrete sections so that the substructure tapers from a wider width at the base portion to a narrower width at an upper end of the plurality of concrete sections.

3. The method according to claim 1 wherein each of the plurality of concrete sections is ring-shaped with at least one central opening therethrough to receive drilling or production risers and wherein the step of installing the concrete sections comprises generally aligning the central openings of each concrete section.

4. The method according to claim 1 wherein each of the plurality of concrete support sections is polygonal-shaped with at least one central opening therethrough to receive drilling or production risers and wherein the step of installing the concrete sections comprises generally aligning the central openings of each concrete section.

5. The method of claim 1 further comprising:

jetting in a lowermost concrete section in the stack of concrete sections into the ocean floor.

6. The method of claim 1 further comprising:

pouring a cement foundation between a lowermost concrete section in the stack of concrete sections and the ocean floor.

* * * * *